US011672293B2

(12) United States Patent
Fildan et al.

(10) Patent No.: US 11,672,293 B2
(45) Date of Patent: Jun. 13, 2023

(54) ULTRA-SLIM FASTENER

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: DUBROSKY & TRACY PATENT SERVICE CORP., Central (HK)

( * ) Notice: Subject to any disclaimer, the term of this patent is extended or adjusted under 35 U.S.C. 154(b) by 225 days.

(21) Appl. No.: 17/213,710

(22) Filed: Mar. 26, 2021

(65) Prior Publication Data

US 2022/0304410 A1 Sep. 29, 2022

(51) Int. Cl.
*A41F 1/00* (2006.01)

(52) U.S. Cl.
CPC ..... *A41F 1/006* (2013.01)

(58) Field of Classification Search
CPC ..... A41F 1/006; A41F 1/00; A44B 13/0047
See application file for complete search history.

(56) References Cited

U.S. PATENT DOCUMENTS 466,803 A * 1/1892 Schodsky ..... A44B 13/0017 24/690
1,854,125 A 4/1932 Faber
2,346,887 A * 4/1944 Winkler ..... A44C 5/2071 24/684
2,765,471 A * 10/1956 Cousins ..... A41C 3/00 24/702
3,293,714 A * 12/1966 Shafer ..... A44B 11/2596 297/468
3,445,901 A * 5/1969 Kamper ..... A41F 1/006 24/695
3,484,907 A 12/1969 Elsenheimer
3,837,049 A 9/1974 Corrado
4,183,121 A 1/1980 Cousins
4,204,300 A 5/1980 Fildan
5,485,658 A 1/1996 Fildan
6,149,496 A * 11/2000 Fildan ..... A41C 3/02 24/694
6,309,489 B1 10/2001 Fildan et al.
6,536,085 B1 3/2003 Milano
6,557,232 B2 5/2003 Fildan et al.
(Continued)

FOREIGN PATENT DOCUMENTS

EP 0084747 A1 8/1983
FR 1409820 A 9/1965
(Continued)

*Primary Examiner* — Robert Sandy
*Assistant Examiner* — Louis A Mercado
(74) *Attorney, Agent, or Firm* — Kintner IP, LLC; Mary Frances Ludwig

(57) ABSTRACT

An ultra-slim fastener for a garment includes male and female parts engagable by inclining the male part while inserting a foot into a cavity of the female part, and pivoting the parts to a co-planar orientation. The female has a roof thickness, and the foot may be offset by at least the roof thickness. The male and female may include flanges which have a symmetrical appearance when engaged. The male and female may include a plurality of protrusions distributed throughout a weld region for welding the parts to a garment piece. Features of the fastener improve tensile strength, increase flexibility, and improve comfort.

22 Claims, 7 Drawing Sheets

(56) References Cited

U.S. PATENT DOCUMENTS

| | | | | |
|---|---|---|---|---|
| D475,946 | S * | 6/2003 | Fildan | D11/216 |
| 6,793,556 | B1 | 9/2004 | Fildan et al. | |
| 6,857,169 | B2 | 2/2005 | Chung | |
| 7,100,250 | B2 * | 9/2006 | Fildan | A41F 1/006 24/DIG. 43 |
| 7,707,698 | B2 | 5/2010 | Gardner | |
| 8,230,559 | B2 * | 7/2012 | Fildan | H01F 7/0263 24/669 |
| 8,302,269 | B2 | 11/2012 | Pitman | |
| 8,745,829 | B2 | 6/2014 | Wanzenboeck et al. | |
| 9,642,407 | B2 | 5/2017 | Fildan et al. | |
| 10,136,690 | B2 * | 11/2018 | Fildan | A44B 17/0041 |
| 10,231,519 | B2 * | 3/2019 | Fildan | A41F 1/006 |
| 10,362,838 | B2 | 7/2019 | Fildan et al. | |
| 10,499,698 | B2 | 12/2019 | Fildan et al. | |
| D878,243 | S | 3/2020 | Fildan et al. | |
| D878,244 | S | 3/2020 | Fildan et al. | |
| 2005/0251970 | A1 | 11/2005 | Fildan et al. | |
| 2017/0135429 | A1 | 5/2017 | Fildan et al. | |
| 2018/0146730 | A1 * | 5/2018 | Fildan | A41F 1/006 |
| 2022/0304427 | A1 * | 9/2022 | Fildan | A44B 11/22 |

FOREIGN PATENT DOCUMENTS

| | | | |
|---|---|---|---|
| GB | 2538109 | A | 11/2016 |
| JP | S547701 | U | 1/1979 |

* cited by examiner

ULTRA-SLIM FASTENER

CROSS REFERENCE TO RELATED APPLICATION

None

TECHNICAL FIELD

This invention relates to an ultra-slim fastener and methods of manufacturing same. In particular, the invention relates to an ultra-slim fastener for use in the manufacture of an article of clothing such as a brassiere.

BACKGROUND OF THE INVENTION

There are many disparate types of fasteners used in the manufacture of articles of clothing. The type of fastener chosen for a given application will depend in part on the intended application, as often different design considerations apply to different applications. For example, fasteners for a brassiere (hereinafter referred to simply as a "bra") will preferably be low profile fasteners, will ideally be relatively simple for the wearer to open and close, and yet will be sufficiently secure so that they are not prone to inadvertent opening during normal movement of the wearer. These are all important considerations when designing a fastener for a bra.

By having a low profile, the fastener will protrude less through the wearer's clothing and will provide a more aesthetically pleasing offering. Furthermore, by having a low profile the fasteners will have less tendency to catch on other items of clothing. It is important that bra fasteners in particular are simple for the wearer to open and close. Often, the closures will be behind the wearer's back and a fastener that is relatively simple to open and close will facilitate dressing and undressing. This is particularly important if the wearer has arthritis or another condition that may affect their manual dexterity.

It is also important that, as well as being relatively simple to open and close deliberately, the fastener must not be prone to inadvertent opening. A fastener that opens inadvertently may cause considerable embarrassment to the wearer as well as inconvenience. For example, if the fastener is part of a bikini or bra, inadvertent opening of the fastener may result in the wearer exposing themselves to others which may be a cause of great distress. Similarly, if the fastener opens unintentionally with regularity, this can be most inconvenient as the wearer will have to resecure the fastener each time it opens. This may require the wearer to leave their current location and go to a place with more privacy, such as a bathroom, so that they can resecure the fastener.

In garment bands or straps having a large lateral width, there is often a tendency for the fabric to roll inward in the region of the fastener. To resist this rolling, rigid bones or stays may be integrated into the garment. However, these bones may have limited flexibility and be uncomfortable to the wearer.

Often, these different design considerations conflict with each other. For example, as a general rule of thumb, the thinner that a fastener is manufactured, the more prone it will be to opening inadvertently. This is particularly the case for fasteners constructed from plastic material. When the fastener constructed from plastic material is made very thin, it will lose much of its structural rigidity and will have a tendency to bend and therefore open inadvertently under an applied load.

There is a need in the art for a fastener that overcomes at least some of the aforementioned problems. It is further desirable that such a fastener offers a useful and aesthetically pleasing alternative choice to the consumer.

Thermoplastic fasteners for garments are commonly joined to fabrics or other components by welding methods including ultrasonic welding, high frequency welding, induction welding, and others. Welding techniques used for synthetic fabrics cause localized melting of the fabric fibers in the area of the weld, which breaks down a woven or knitted fabric structure. The use of too much energy when welding may cause excessive melting of plastic parts which may be unsightly, rough to the touch, and may even weaken the part.

There is therefore a need in the art for improved methods of welding thermoplastic components to fibers to maintain structural integrity, comfort, and appearance in the welded regions.

BRIEF SUMMARY OF THE EMBODIMENTS

An ultra-slim fastener as described herein is suitable for bras, swimwear, sportswear, and other garments where a slim yet strong fastener is desired. The fastener may be, for example, a brassiere front fastener located in between the cups where a thin profile is desired for comfort, yet high strength is also required to prevent inadvertent disengagement of the fastener.

In an embodiment, an ultra-slim fastener for securing a first piece and a second piece of a garment together includes:

- a male part configured to be mounted on the first piece and a female part configured to be mounted on the second piece;
- the male part including a substantially planar body having an outermost body end, a downwardly depending leg disposed at the outermost body end and terminating in an outwardly projecting foot extending substantially parallel to the plane of the body, the foot having a heel portion oriented away from the outermost body end;
- the female part including a substantially planar frame having a top, an outermost frame end, an innermost frame end, and defining a cavity for reception and retention of the foot, the cavity being partially roofed in towards the innermost frame end and having a roof and a bottom, thereby defining an open mouth towards the outermost frame end;
- the foot, the cavity, and the open mouth being dimensioned so that insertion of the foot into the cavity must be realized by inclining the body of the male part relative to the frame of the female part before bringing the male part and the female part together, retention of the foot in the cavity is realized by pivoting the inserted male part from an inclined orientation to a co-planar orientation with respect to the female part using the roof of the cavity as a fulcrum, and release of the foot from the cavity is realized by pivoting the inserted male part from the co-planar orientation back to the inclined orientation using the roof of the cavity as a fulcrum before moving the male part and the female part apart;
- a fabric strip and an overlay, the overlay having an aperture, the frame of the female part sandwiched between the fabric strip and the overlay such that the aperture corresponds with the open mouth, the fabric strip forms a backing for the frame, and the bottom of the cavity is closed off by the fabric strip; and
- wherein the frame of the female part has a roof thickness extending from the top of the frame to the roof of the cavity, and an upper surface of the foot is offset rearwardly relative to a rear surface of the body of the male part by a distance of at least the roof thickness.

Such a fastener can be made ultra-slim, less than 5 mm in thickness from front to rear, while maintaining structural integrity and the ability to resist inadvertent opening under an applied load. By mounting the female part's frame directly onto the face of the fabric strip so that the fabric strip forms a backing for the frame and providing an overlay on top of the frame in the manner described, the frame will have significantly greater structural integrity and resistance to bending under tensile strain. This allows for a thinner fastener to be used. Embodiments of the fastener will have a tensile strength rating of 30-40 lbs or more, which far exceeds the amount for fasteners of this type and will not be inclined to open inadvertently.

Furthermore, the fabric strip backing will provide greater resistance to the pivoting motion required for release of the male part and have a tendency to keep the male part and the female part in a substantially planar, locked configuration. This will further obviate the possibility of the fastener releasing inadvertently under normal movement by the wearer.

In another embodiment of the ultra-slim fastener, the cavity has a side wall adjacent the outermost frame end and inclined towards the outermost frame end from front to rear, and the heel portion of the foot is inclined away from the outermost body end from front to rear. In embodiments, the heel portion is inclined away from the outermost body end at an angle of between about 6 degrees and about 12 degrees. The incline of the heel portion resists disengagement when the fastener is under tensile stress, providing an increased tensile strength.

In another embodiment of the ultra-slim fastener, the heel portion of the foot is outwardly curved in a lateral direction. This feature improves the ease of coupling of the male part with the female part.

In another embodiment of the ultra-slim fastener, the body of the male part includes an upwardly extending male flange adjacent the outermost body end and the frame of the female part includes an upwardly extending female flange adjacent the open mouth. The upwardly extending male flange and the upwardly extending female flange are substantially symmetrical in a front view with the male part and the female part fully engaged. In some embodiments, the overlay abuts the upwardly extending female flange. In some embodiments, the frame of the female part is a different color from the overlay. These features provide a slim and attractive exterior appearance of the fastener. Additionally, the features provide a fastener where the majority of the plastic frame or body is covered with fabric, which is beneficial to prevent contact between the plastic and a wearer's skin, thus reducing the risk of allergic reaction or other skin irritation.

In another embodiment of the ultra-slim fastener, the female part includes two wings extending laterally from opposing sides of the frame. In another embodiment of the ultra-slim fastener, the body of the male part includes two longitudinal channels positioned on opposing sides of the foot. These features create a strong yet flexible fastener, particularly suitable for a fastener of large lateral size. Furthermore, such wings resist the tendency of a garment band to roll in the lateral direction, and may provide a comfortable alternative to commonly used lateral bones or stays.

In an embodiment, the ultra-slim fastener includes only a single female part in the lateral direction, sandwiched between the fabric strip and the overlay. The use of only a single female mouth for engagement with a single male foot provides a fastener which is simple to close with a single click, and eliminates the possibility of misalignment or incomplete coupling presented when multiple female parts must be engaged with multiple male parts. In another embodiment, such a fastener does not include any secondary or supplemental fasteners to completely join the first and second garment pieces.

In another embodiment of the fastener, the body of the male part and the frame of the female part each having a weld region including a plurality of protrusions distributed throughout the weld region in a pattern. The protrusions permit a strong weld and allow flexibility of the weld region while maintaining structural integrity of the welded parts. In some embodiments, the protrusions have a height of between 0.3 mm and 2.0 mm. In some embodiments, the protrusions have a conical shape, a cylindrical shape, or a cuboid shape. In some embodiments, the pattern has an interstitial spacing of between 1 mm and 5 mm separating the protrusions. In some embodiments, the plurality of protrusions covers between 40% to 60% of each weld region.

Other embodiments, in addition to the embodiments enumerated above, will become apparent from the following detailed description, taken in conjunction with the accompanying drawings, which illustrate, by way of example, the principles of the fastener and method of manufacturing same.

BRIEF DESCRIPTION OF THE DRAWINGS

Non-limiting and non-exhaustive embodiments of the ultra-slim fastener are described with reference to the following figures, wherein like reference numerals refer to like parts throughout the various views unless otherwise specified.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

Figure 1:
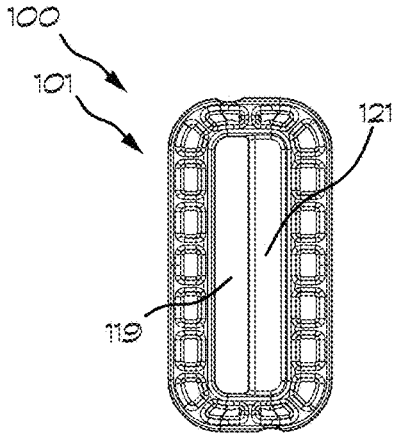
FIG. 1 is a rear view of a female part of a fastener.
Figure 3:
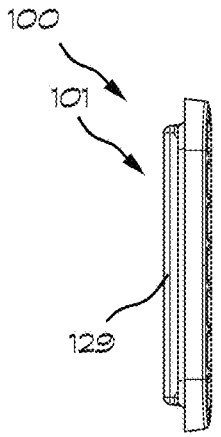
FIG. 3 is an inner end view of the female part of FIG. 1.
Figure 2:
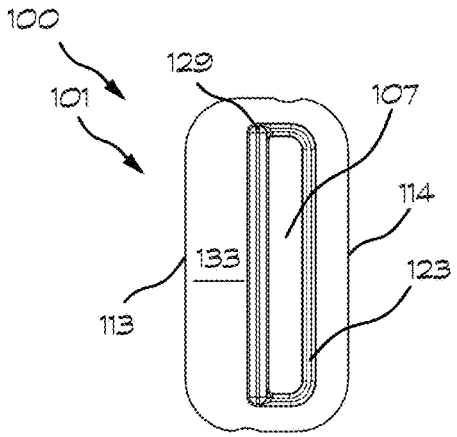
FIG. 2 is a front view of the female part of FIG. 1.

Referring to FIGS. 1-3, there is shown an embodiment of a female part of a fastener, indicated generally by the reference numeral 100, having a substantially planar frame 101. Frame 101 includes a cavity 119 configured for reception and retention of a foot of a male part, discussed in detail below. Cavity 119 is partially roofed in by a roof 121 located near the innermost frame end 113. An open mouth 107, located near an outermost frame end 114, permits access to cavity 119.

As used herein, the term "inner" refers to the direction of a garment piece to which the male or female parts is to be connected, while "outer" refers to the direction away from the garment; "front" refers to the direction generally facing away from the body of the wearer and "rear" refers to the direction toward the body of the wearer, regardless of the location of the fastener on a garment. The term "about" or "approximately" refers to a range of values within plus or minus 10% of the specified number.

Figure 4:
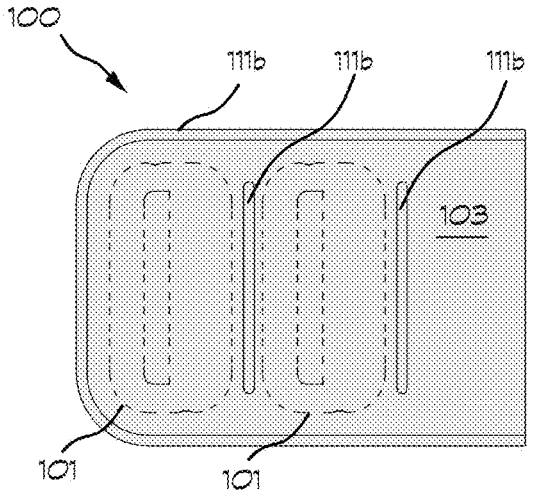
FIG. 4 is another rear view of the female part.
Figure 5:
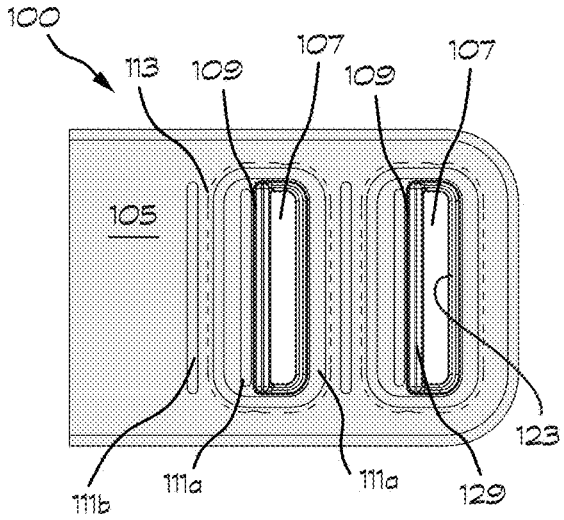
FIG. 5 is a front view of the female part of FIG. 4.

FIGS. 4 & 5 show female part 100 having two frames 101 sandwiched between a fabric strip 103 and an overlay 105. Overlay 105 is mounted onto the top of each frame and onto the face of the fabric strip 103, sandwiching frames 101 between overlay 105 and fabric strip 103. Overlay 105 includes an aperture 109 corresponding with each open mouth 107 of frames 101. Fabric strip 103 forms a backing for frames 101, and the bottom of cavity 119 is closed off by the fabric strip (see also FIG. 6).

A plurality of weld joints 111*a*, 111*b* illustrate areas where at least two of the frame, the overlay, and the fabric strip have been joined together. In the shown embodiment, overlay 105 may be welded to frame 101 along weld joints 111*a*. Overlay 105 may be welded to fabric strip 103 along weld joints 111*b*. Weld joints 111*b* shown spaced apart from innermost frame end 113 of the female part may provide strain relief in areas of the fabric which may be manipulated when engaging or disengaging the fastener.

Figure 7:
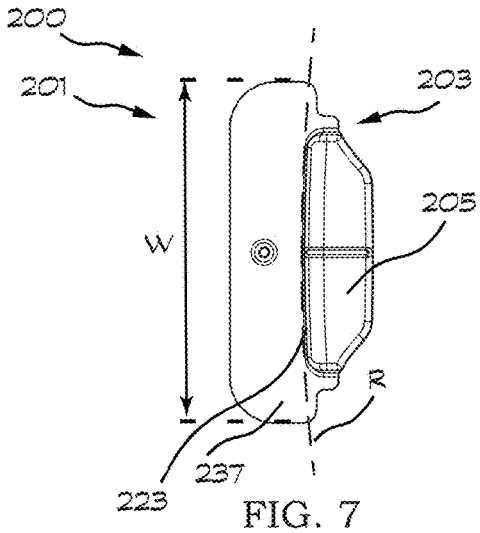
FIG. 7 is a rear view of a male part of a fastener.
Figure 9:
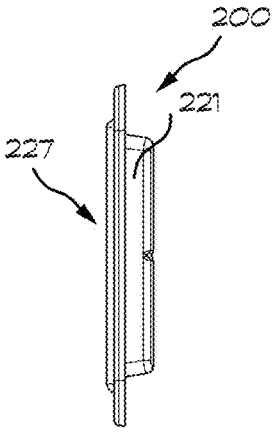
FIG. 9 is an inner end view of the male part of FIG. 7.
Figure 8:
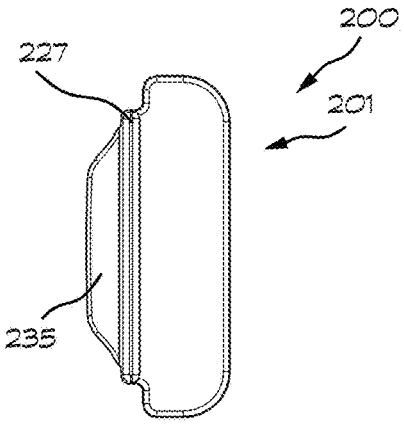
FIG. 8 is a front view of the male part of FIG. 7.

Referring to FIGS. 7-9, there is shown an embodiment of a male part of the fastener, indicated generally by the reference numeral 200. The male part comprises a substantially planar body 201 having at its outermost body end 203 a downwardly depending leg 221 terminating in an outwardly projecting foot 205. The outwardly projecting foot extends substantially parallel to the plane of body 201 (see FIG. 12). Foot 205 has a heel portion 223 oriented away from outermost body end 203 and a toe portion 225 oriented toward the outermost body end.

Figure 10:
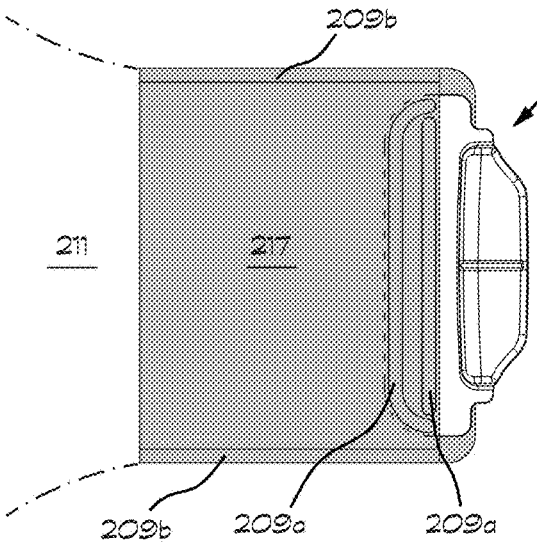
FIG. 10 is another rear view of the male part.
Figure 11:
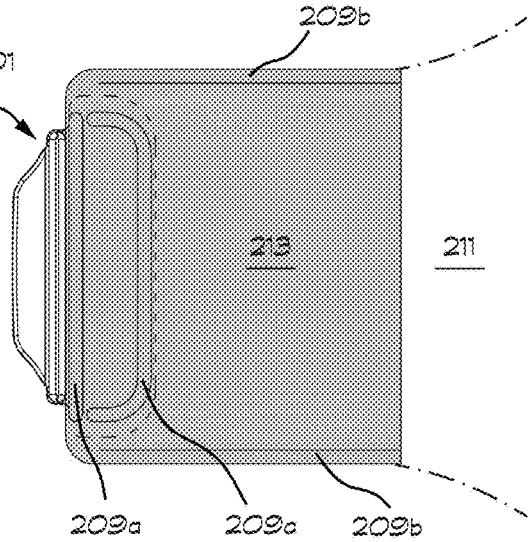
FIG. 11 is a front view of the male part of FIG. 10.

FIGS. 10 & 11 show body 201 of the male part sandwiched between an upper component 213 and a lower component 217, and connected thereto along weld joints 209*a*. The outline of body 201 is shown in dashed lines. Upper component 213 and lower component 217 may be welded together along weld joints 209*b*. Upper component 213 and lower component 217 may extend outwardly from body 201, thereby forming a flap that may be used for connection of the male part to a first piece of a garment 211, shown in dot-dash lines.

Figure 12:
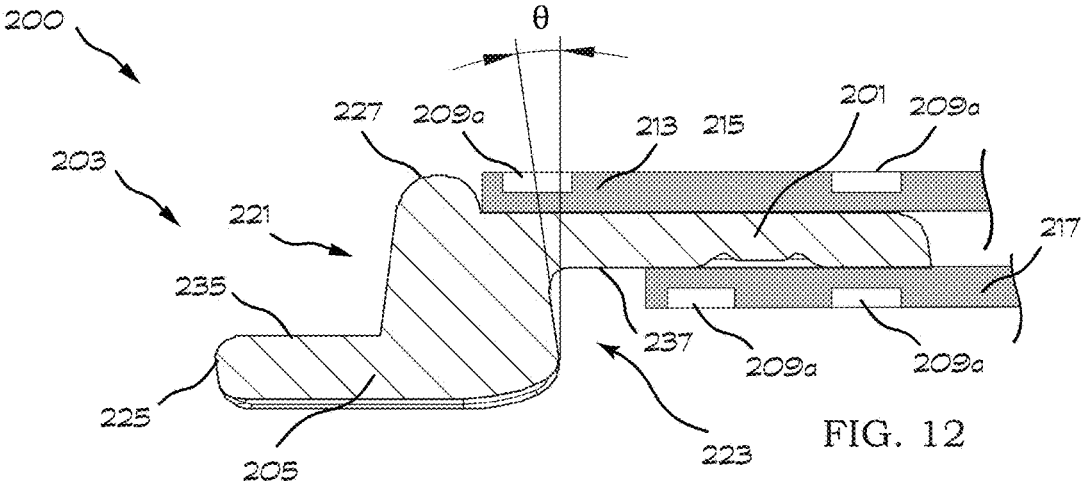
FIG. 12 is an enlarged side cross-sectional view of the male part of FIG. 10.

FIG. 12 shows an enlarged, side cross-sectional view of male part 200 of the fastener. Outwardly projecting foot 205 extends substantially parallel to the plane of body 201. Heel portion 223 is inclined away from outermost body end 203 from front to rear. In other words, the front of heel portion 223 is nearer to outermost body end 203 than is the rear of heel portion 223. The angle of inclination of the heel is indicated as θ. In embodiments, heel portion 223 is inclined away from the outermost body end at an angle, θ, of between about 6 degrees and about 12 degrees. In addition, an upwardly extending male flange 227 protrudes from the front surface of body 201 adjacent outermost body end 203.

Figure 6:
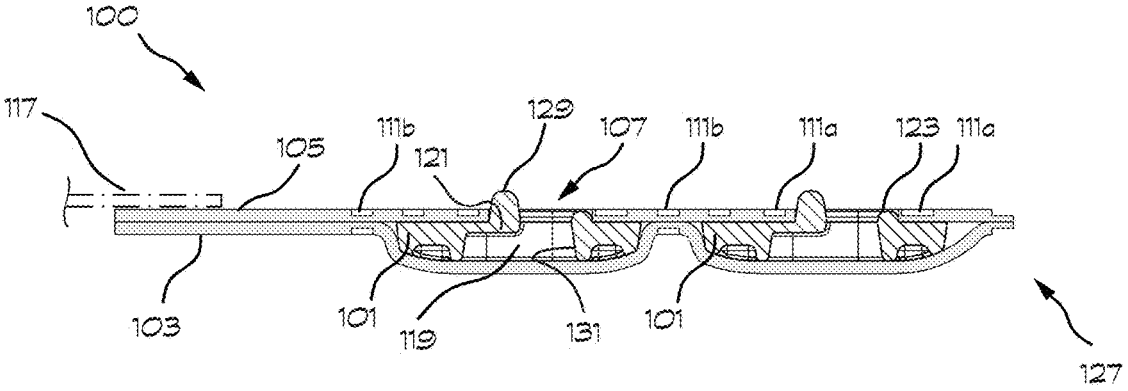
FIG. 6 is an enlarged side cross-sectional view of the female part of FIG. 4.

Referring now to FIG. 6, there is shown an enlarged, side cross-sectional view of female part 100 of the fastener. As outlined above in relation to FIGS. 1-5, female part 100 has a substantially planar frame 101 sandwiched between overlay 105 and fabric strip 103. In the embodiment shown, there are two of frame 101 mounted in a longitudinally spaced row. This arrangement is not intended to be limiting, and more or fewer frames may be provided depending on the degree of adjustability desired.

Frame 101 includes an upwardly extending female flange 129 adjacent open mouth 107. Upwardly extending female flange 129 acts as a backstop for the male part when male part 200 is being joined together with female part 100. In some embodiments, a circumferential upstanding collar 123 is provided which surrounds open mouth 107 and protrudes forwardly therefrom. This collar protects the edge of the aperture in fabric overlay 105. Cavity 119 has a side wall 131, oriented toward outer end 127 of the female part. Side wall 131 is angled from front to rear towards outer end 127. This angle facilitates engagement of the male and female parts once the male and female parts come under tension, and resists disengagement of the fastener.

Overlay 105 is shown connected to frame 101 along weld joints 111*a*. Overlay 105 and fabric strip 103 may be connected together along weld joints 111*b*. The overlay and the fabric strip may extend outward from frame 101, thereby forming a flap that may be used for connection of the female part to a second piece of a garment 117, shown in dot-dash lines. Alternatively, garment piece 117 may be sandwiched between overlay 105 and fabric strip 103.

Figure 13:
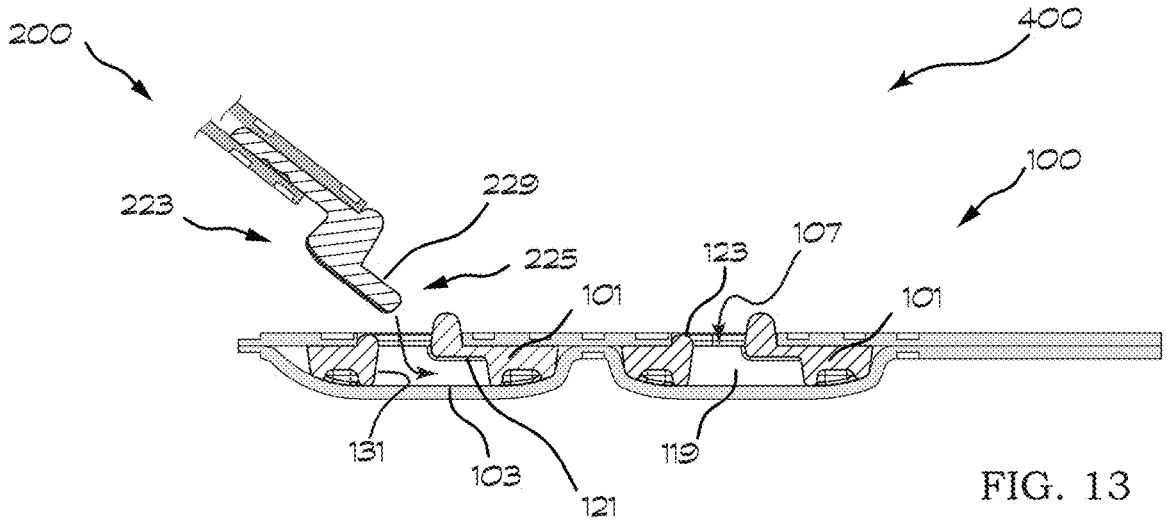
FIG. 13 is an enlarged side cross-sectional view showing the male part being brought into engagement with the female part.

FIG. 13 shows a fastener, indicated generally by the reference numeral 400. Male part 200 is positioned for insertion into a frame 101 of female part 100 (two frames 101 are present in the shown embodiment). Male part 200 is inclined at an angle to the horizontal so that it can be inserted into cavity 119 through open mouth 107 of the cavity. Toe portion 225 is inserted first into the open mouth along the directional arrow, and when a bridge 229 of the foot engages with roof 121 of the cavity, the foot will be pivoted in a counter-clockwise direction using roof 121 as a fulcrum. Heel portion 223 will abut against collar 123 and the collar or the heel will be sufficiently resiliently deformable to allow the heel to snap in place beyond the collar so that the foot is lying substantially horizontal in the cavity (see FIG. 16). In other words, the male and female parts will be substantially in line with each other rather than either being in an inclined position. Once engaged, the fastener will resist inadvertent release, as the foot will be engaged in the cavity and the foot (and in particular heel portion 223 and bridge 229) together with cavity side wall 131, collar 123, and roof 121 will act to hold the foot in the cavity and male part 200 and female part 100 together. Furthermore, fabric strip 103 will also act to prevent inadvertent dislodgement of the male part from the female part as it will act against a pivoting motion of the male part from a parallel configuration to an inclined configuration. It will also act to press bridge 229 of the male part against roof 121 which helps to maintain the parts together. Release of the foot from the cavity is realized by pivoting the inserted male part from the co-planar orientation back to the inclined orientation using the roof of the cavity as a fulcrum before moving the male part and the female part apart, essentially reversing the operations performed when engaging the fastener.

Figure 14:
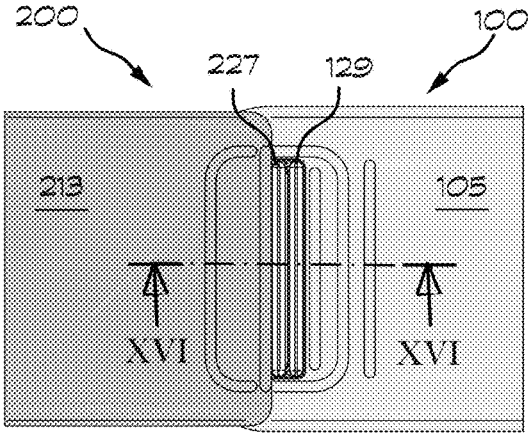
FIG. 14 is a front view of an embodiment of the fastener in an engaged position.
Figure 15:
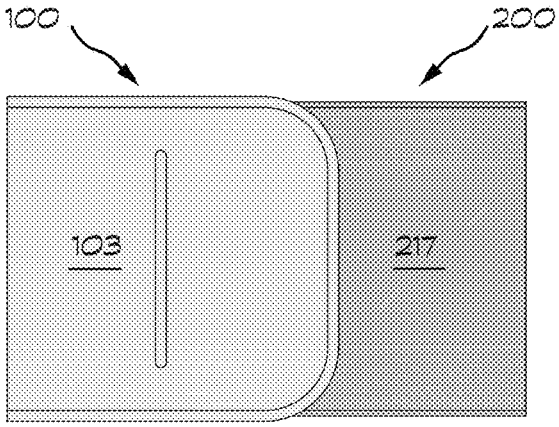
FIG. 15 is a rear view of the embodiment of FIG. 14.
Figure 16:
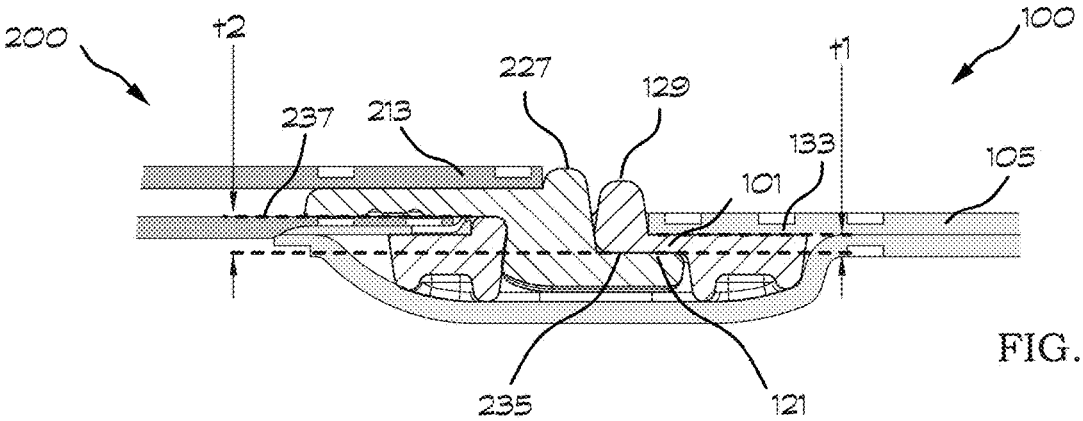
FIG. 16 is an enlarged cross-sectional view along line XVI-XVI of FIG. 14.

FIGS. 14 and 15 are front and rear views, respectively, of an embodiment of the fastener in a closed position. FIG. 16 is an enlarged cross-sectional view along line XVI-XVI of FIG. 14. Frame 101 of female part 100 has a roof thickness, t1, extending from a top 133 of frame 101 to roof 121 of the cavity. An upper surface 235 of the foot is offset rearwardly relative to a rear surface 237 of the body of male part 200 by a distance, t2 (see also FIG. 12). This offset distance t2 is at least as large as roof thickness t1. In example embodiments, t1 may be between about 0.4 mm and about 1.0 mm.

In the embodiment of FIG. 14, overlay 105 abuts upwardly extending female flange 129. Similarly, upper component 213 abuts upwardly extending male flange 227. With the male part and the female part fully engaged, upwardly extending male flange 227 and upwardly extending female flange 129 are substantially symmetrical as viewed from the front view of FIG. 14. The offset of roof 121 from top 133 of the frame by roof thickness t1 allows for the thin form (e.g., narrow lateral dimension) of upwardly extending female flange 129, resulting a symmetrical appearance of the closed fastener. The flatness and low profile provided by these features enhance comfort in addition to being aesthetically pleasing.

Figure 17:
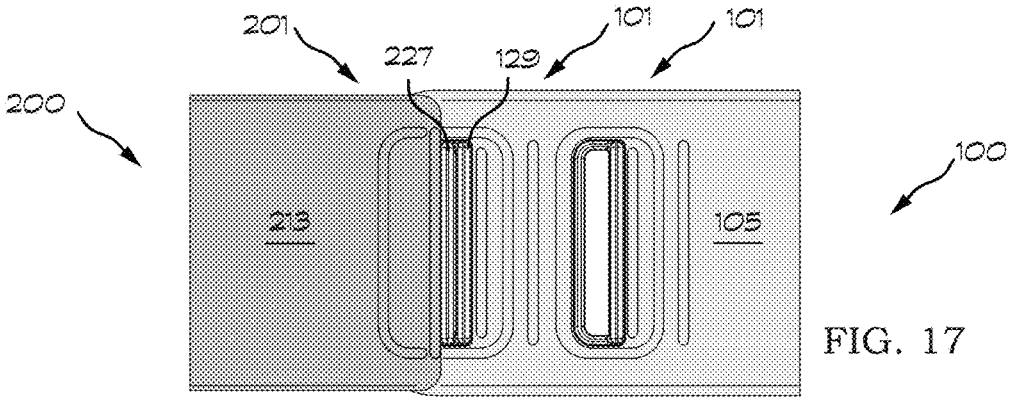
FIG. 17 is a front view of another embodiment of the fastener in an engaged position.
Figure 18:
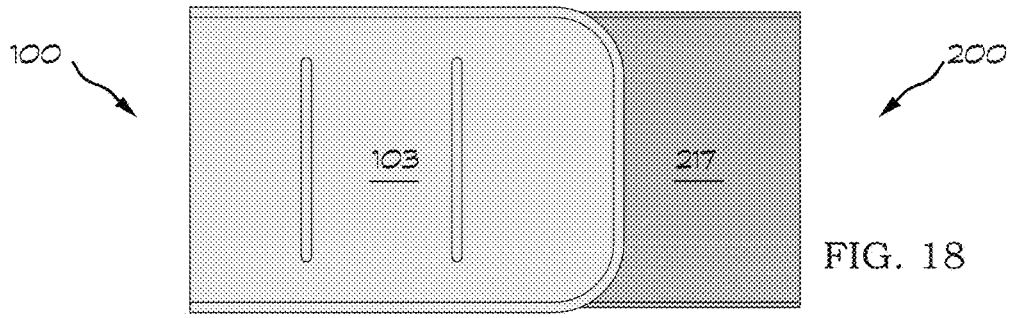
FIG. 18 is a rear view of the embodiment of FIG. 16.
Figure 19A:
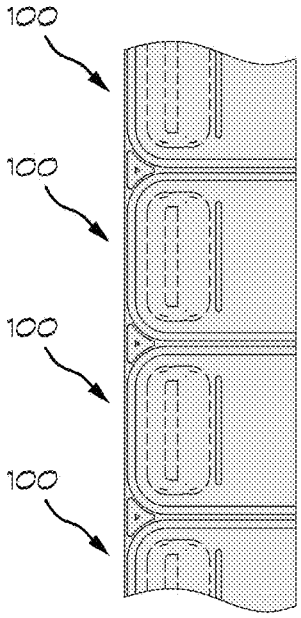
FIG. 19A is a rear view of a strip including multiple female parts.
Figure 19B:
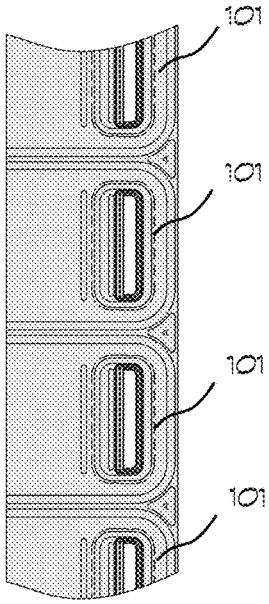
FIG. 19B is a front view of the strip.

FIGS. 17 & 18 show another embodiment of the fastener, where the female part includes two frames 101 mounted to overlay 105 in a longitudinally spaced row. More or fewer frames 101 could be provided for reception of the male part of the fastener, to provide fasteners with a greater or lesser range of adjustability. It is envisaged however that the fastener as shown provides a degree of adjustability and is considered to be an adjustable fastener.

Overlay 105 may be differently styled from frame 101, such as in color, texture, or pattern. Upper component 213 of male part 200 may be of similar style to overlay 105, while body 201 of the male part may be styled like frame 101. Providing a first color for the frame and body in contrast to a second color for the garment pieces would provide a visual indicator of the fastener location to assist in engaging or disengaging the fastener. In some embodiments, the male part may have a first color which contrasts with a second color of the female part.

Referring again to FIG. 7, in some embodiments heel portion 223 of male part 200 may be outwardly curved in the lateral direction, as indicated by dashed line R. Radius of curvature R may be several times larger than the lateral dimension of the fastener. For example a fastener having a lateral width, W, of about 25 mm may have a radius R of about 125 mm, about 150 mm, or about 175 mm. This feature improves the ease of coupling of the male part with the female part, as the central region of the heel may resiliently deform under the stress of coupling. This coupling action may produce an audible click, which provides confirmation that the fastener is fully engaged.

The fastener is preferably made out of plastic material, such as polyamide. Fabric components may be made of polyamide microfiber, elastane fabric, silk, polyester, bamboo, cellulose acetate, or combinations thereof. In some embodiments, both the fabric portion and the solid plastic portion of the fastener are made of polyamide. If desired, an additional layer of padding material could be provided for comfort. Although this will increase the depth of the fastener, for example the padding layer may be of the order of 0.5-1.0 mm thick leading to a fastener that could be of the order of 5 mm thick or more, the padding may provide a more comfortable fastener for the wearer thereby improving the desirability of the fastener. An "ultra-slim" fastener will be understood to be a fastener having a thickness of the order of 5 mm or less.

In order to manufacture a fastener according to the invention, the method comprises the steps of cutting out an aperture in an overlay sheet before bonding the overlay sheet to a fabric strip along at least one edge of both the overlay sheet and the fabric strip. The frame of the female part is placed on the overlay sheet with the open mouth of the frame in alignment with the aperture in the overlay sheet. The frame of the female part is bonded to the overlay sheet. The overlay sheet is additionally bonded to the fabric strip along any remaining un-bonded edges. It is envisaged that in one implementation, the initial step of bonding the overlay sheet to the fabric strip along at least one edge of both the overlay sheet and the fabric strip will entail bonding the overlay sheet to the fabric strip along three edges of the overlay sheet and the fabric strip thereby forming a pouch. The male part is constructed by bonding the fabric to the substantially planar body. In all cases, ultrasonic welding is seen as a useful choice for bonding the components together.

Figure 20A:
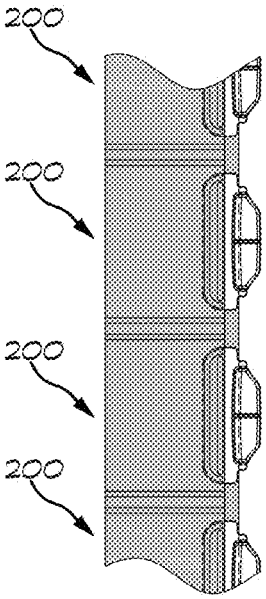
FIG. 20A is a rear view of a strip including multiple male parts.
Figure 20B:
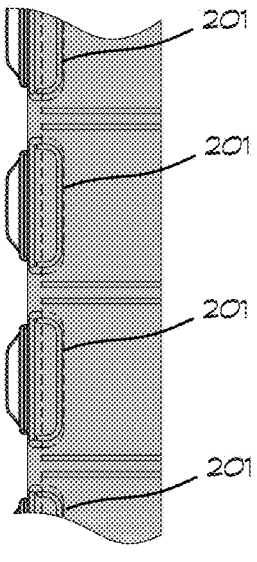
FIG. 20B is a front view of the strip.
Figure 21:
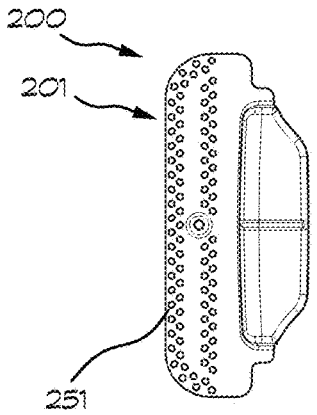
FIG. 21 is a rear view of another embodiment of the male part.
Figure 23:
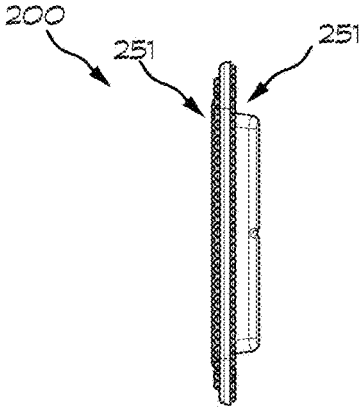
FIG. 23 is an inner end view of the male part of FIG. 21.
Figure 22:
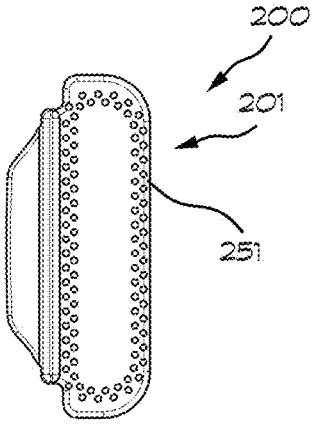
FIG. 22 is a front view of the male part of FIG. 21.
Figure 24:
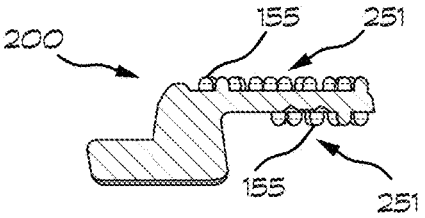
FIG. 24 is an enlarged side cross-sectional view of the male part of FIG. 21.
Figure 26:
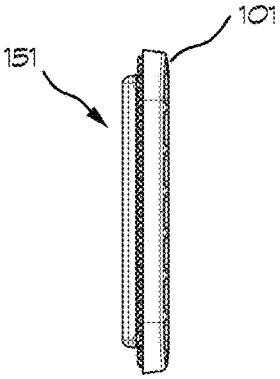
FIG. 26 is an inner end view of the female part of FIG. 25.
Figure 25:
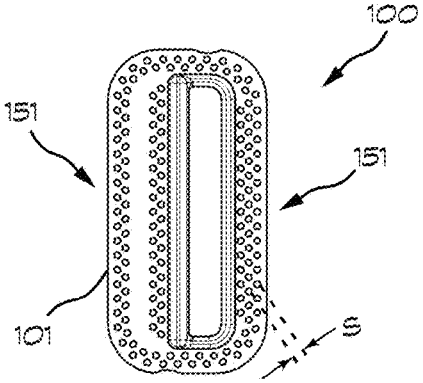
FIG. 25 is a front view of another embodiment of the female part, the rear view being identical to FIG. 1.

FIGS. 19A-B and 20A-B illustrate an intermediate manufacturing step, including strips including of multiple bonded female parts (FIG. 19A-B) or multiple bonded male parts (FIG. 20A-B). The strips may be cut after bonding to provide multiple fasteners.

Additional embodiments of the male and female parts are shown in FIGS. 21-27. In these embodiments, the body of the male part has weld regions 251 for welding body 201 to a piece of fabric (see weld joints 209*a* of FIGS. 10 & 11). Similarly, the frame of the female part has weld regions 151 for welding frame 101 to a piece of fabric (see weld joints 111*a* of FIGS. 5 & 6). Each of weld regions 151, 251 includes a plurality of protrusions 155 which are distributed substantially evenly throughout the weld regions. These protrusions improve the weld connection between the fabric and the plastic base or frame. The protrusions may permit welding at a lower temperature or for a shorter time, reducing the risk of over-welding which can cause excessive melting of plastic parts or may breakdown the structure of a woven fabric.

Figure 27:
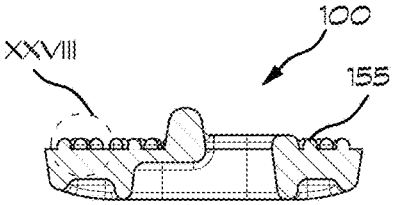
FIG. 27 is an enlarged side cross-sectional view of the female part of FIG. 25.
Figure 28A:
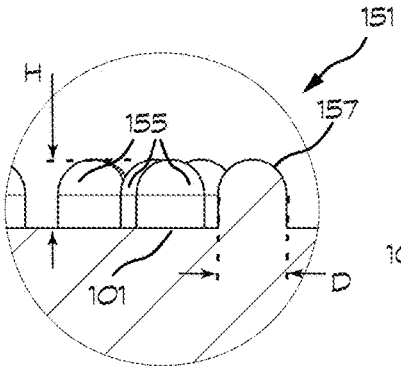
FIGS. 28A-28C are enlarged views of embodiments of area XXVIII of FIG. 27.
Figure 28B:
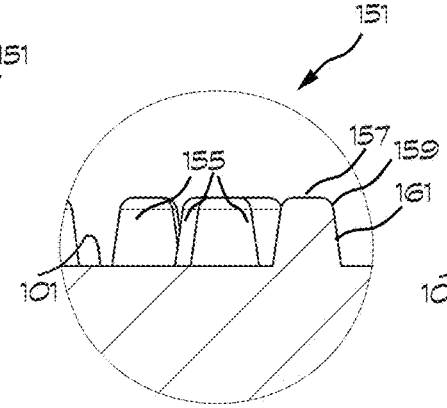
Figure 28C:
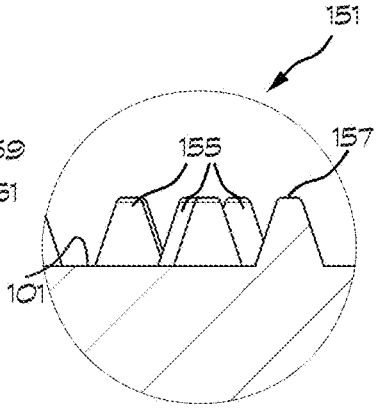

FIGS. 28A-28C are enlarged views of embodiments of detail area XXVIII of FIG. 27. The features of the embodiments shown may also apply, mutatis mutandis, to the weld regions of the male part. Protrusions 155 are raised relative to frame 101 by a height 'H'. Protrusions 155 may have a height of between about 0.3 mm and about 2.0 mm. In the shown embodiments, protrusions 155 have a height of about 0.5 mm. In other embodiments, the height of the protrusions is at least 50% of the thickness of the fabric to be welded. In other embodiments, the height of the protrusions is between 30-70% of the thickness of the fabric to be welded. When welded, the protrusions are fused with the fabric and have a substantially flat, smooth finished appearance.

In embodiments, protrusions 155 are spaced in a regular pattern throughout the weld regions. As shown on male part 200, the protrusions may form a zig-zag pattern. As shown on female part 100, the protrusions may form a lattice-like pattern. Within each weld region, protrusions may cover between 40% to 60% of the surface area (e.g. as measured at the body or frame). The ratio within the weld region of surface area covered by protrusions to the total area of the patterned surface may be varied according to the type of material being joined and the desired flexibility of the resultant weld. In another embodiment, protrusions cover about 50% of the weld region. Protrusions may have a major dimension, 'D', at the base of about 0.5 mm.

In embodiments, the pattern has an interstitial spacing 'S' (see FIG. 25) separating each of the plurality of protrusions (in other words, separating one of the plurality of protrusions from a nearest neighbor among the plurality of protrusions). Spacing S may be between about 1 mm and about 5 mm. In another embodiment, spacing S may be between about 1 mm and about 3 mm. A larger interstitial spacing may be preferred for welding to a thicker fabric.

The embodiments of FIGS. 28A-28C illustrate several exemplary shapes of protrusions 155. Protrusions of FIG. 28A have a cylindrical shape with a rounded top at raised surface 157. Protrusions of FIG. 28B have a generally cuboid shape, a substantially flat raised surface 157 with a rounded edge 159, and sidewalls 161 which have a slight downward taper. Protrusions of FIG. 28C have a conical shape which tapers downward away from raised surface 157 toward frame 101 at an angle of between 20° and 60°. Raised surface 157 is substantially flat. In other embodiments, the protrusions may be more rounded than as shown, may be tapered at an angle more or less than is shown, may have straight sidewalls 161, may have angled edges 159 on the raised surface, or may have various shapes at the base such as circular, square, or polygonal.

Figure 31:
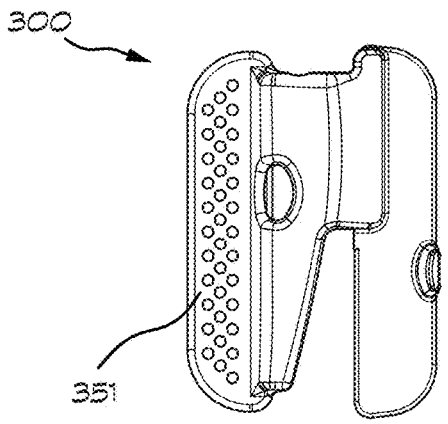
FIG. 31 is a front view of another embodiment of one part of a fastener.
Figure 32:
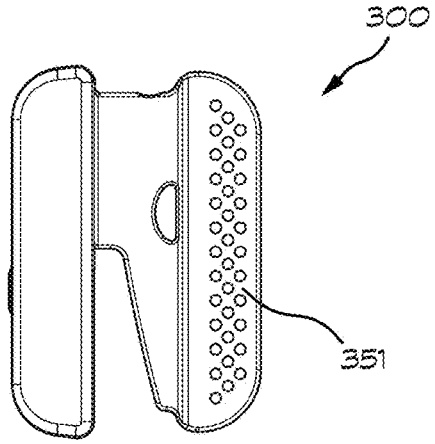
FIG. 32 is a rear view of the part of FIG. 31.
Figure 33:
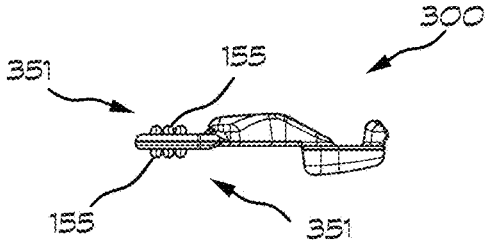
FIG. 33 is a side cross-sectional view of the part of FIG. 31.

Further provided are other embodiments of fastener parts including weld regions having protrusions substantially as described above. FIGS. 31-33 are front, rear, and cross-sectional views, respectively, of such a fastener, where two identical parts 300 are configured to be fastened together. Part 300 includes weld regions 351 on the front and rear faces, for welding the part to a garment piece or other fabric. Weld regions 351 each have a pattern of protrusions 155. In the shown embodiment, protrusions 155 are arranged in a lattice-like pattern, have rounded tops, and have straight sidewalls. It will be understood by a skilled artisan that protrusions 155 may have various forms and arrangements as described above while achieving an equivalent result.

Figure 29:
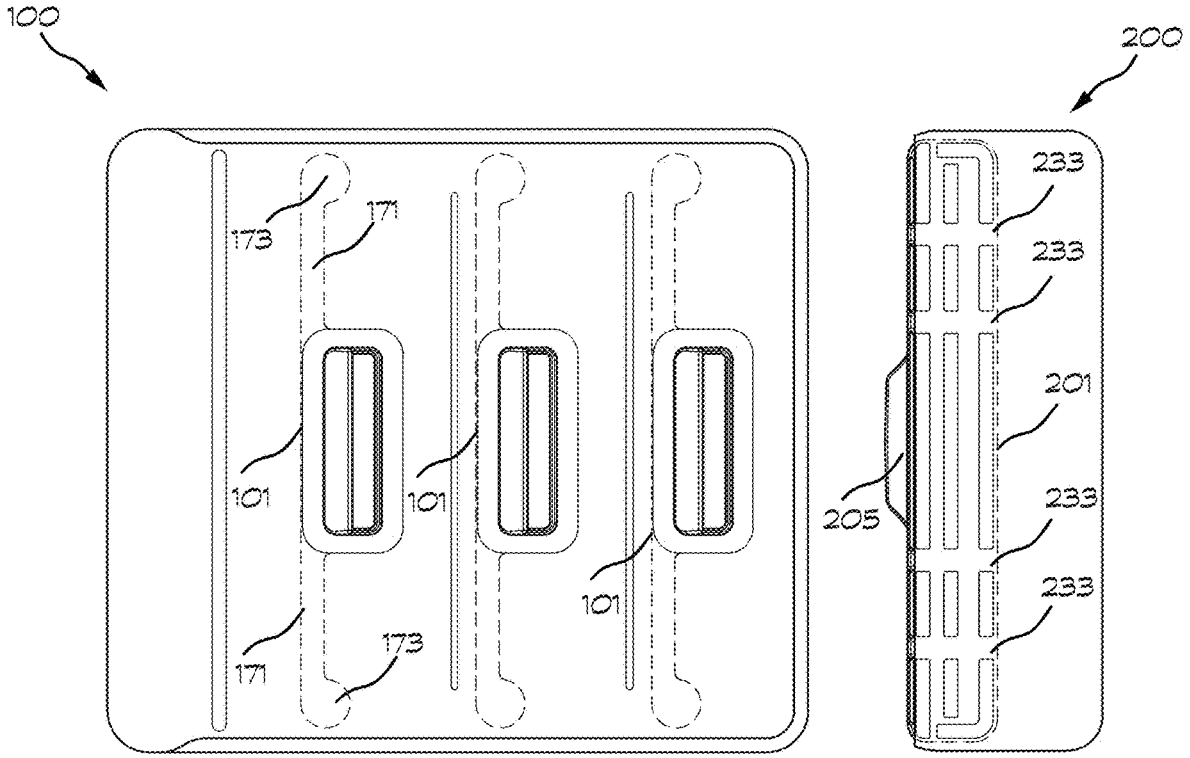
FIG. 29 is a front view of another embodiment of the fastener in a disengaged position.
Figure 30:
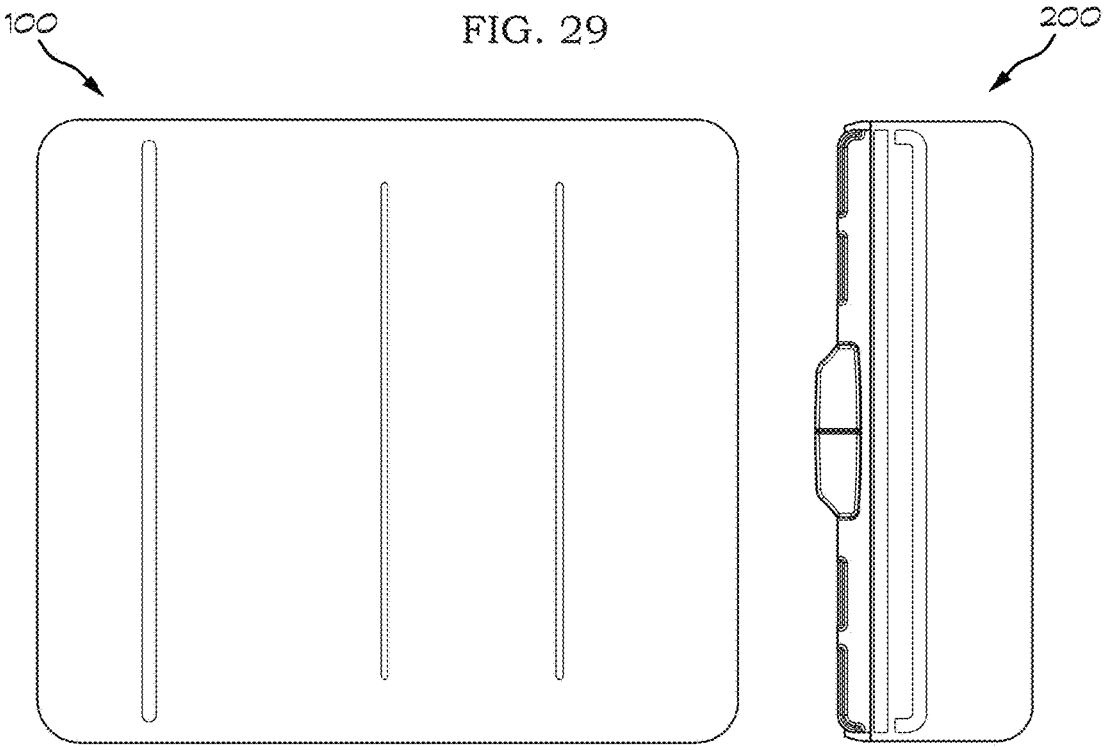
FIG. 30 is a rear view of the embodiment of FIG. 29.

FIGS. 29-30 show another embodiment of the fastener having a large lateral width. For example, the lateral width may be between about 50 mm and about 120 mm. Frames 101 of female part 100 and body 201 of male part 200 are shown hidden in dashed lines in FIG. 29. The female parts include two wings 171 which extend laterally from opposing sides of the frame. Wings 171 provide additional strength for the closure, which is especially beneficial when a larger sized closure is desired. As shown, wings 171 extend laterally from the frame adjacent innermost frame end 113, and each wing has a rounded wing end 173 projecting outward. Wings 171 may be thinner than frame 101, for example the wings may have a thickness of about one half of the frame thickness. This feature provides a degree of flexibility, improving comfort. In addition, the wings may eliminate the need for additional stays to prevent fabric rolling in a wide garment band.

Body 201 of male part 200 includes at least two longitudinal channels 233, one channel positioned on either side of foot 205. The shown embodiments includes four channels 233, two channels located on each side of the foot. Channels 233 have a reduced thickness relative to other regions of body 201. The relatively thin structure in the regions of channels 233 provides a flexible region which bends resiliently under stress, thereby further facilitating the engagement and disengagement of the fastener. In addition, the flexibility of the male provides additional comfort to the wearer, especially when moving around.

Despite the large lateral size of the fastener of FIG. 29-30, only a single female part and only a single male part are present in the lateral direction to join the garment pieces. Having a single male part which clicks into a single female part provides a simple engagement and overcomes the fastening challenges presented when multiple small hooks must be engaged, especially behind the back of the wearer. The embodiment shown provides ease of engagement while meeting the high strength and support requirements of a large fastener.

Figure 34:
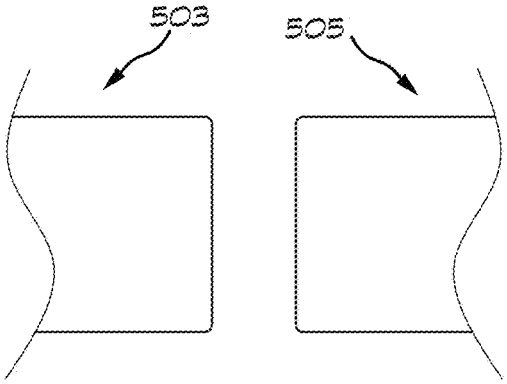
FIG. 34 is a front view of two fabric pieces.
Figure 35:
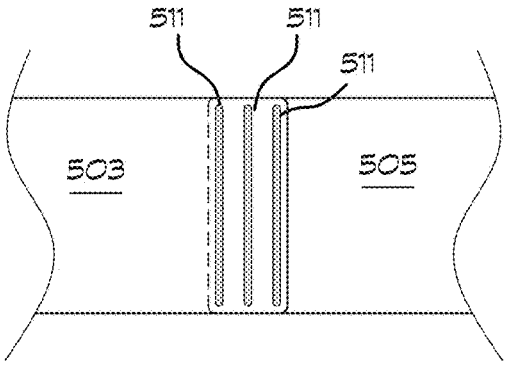
FIG. 35 is a front view of a weld pattern for joining the two fabric pieces.
Figure 36:
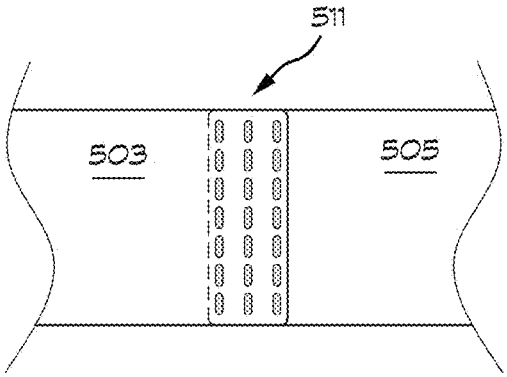
FIG. 36 is a front view of another weld pattern for joining the two fabric pieces.

FIGS. 34-36 illustrate welding of two fabric pieces 503 and 505. As discussed above with reference to FIG. 6, either the female part or the male part may have a flap for welding to a garment piece (see 103, 105, 117). The flap itself (103, 105) may include weld joints (111*b*). FIG. 34 shows two fabric pieces 503, 505 either one of which may be connected to a fastener part. Fabric pieces may be welding together along weld joints 511. As shown in FIG. 35, several weld joints may be longitudinally spaced to increase strength of the connection while still providing flexibility. As shown in FIG. 36, an array of weld joints 511 may be spaced longitudinally and laterally, to provide an even greater degree of flexibility. Having smaller weld regions may also be desirable to preserve the integrity of thin or delicate fabrics. In other embodiments, more or fewer weld regions may be present and the weld regions may have various shapes or dimensions.

It is further envisaged that the fastener could be used for shoulder straps and is not limited to a back or front fastener for a brassiere, for example.

Further provided is a garment including a fastener as shown or described herein.

The embodiments of the fastener described herein and garments incorporating same are exemplary and numerous modifications, combinations, variations, and rearrangements can be readily envisioned to achieve an equivalent result, all of which are intended to be embraced within the scope of the appended claims. Further, nothing in the above-provided discussions of the fastener and construction method should be construed as limiting the invention to a particular embodiment or combination of embodiments. The scope of the invention is defined by the appended claims.

We claim:

1. An ultra-slim fastener for securing a first piece and a second piece of a garment together, the fastener comprising:

a male part configured to be mounted on the first piece and a female part configured to be mounted on the second piece;

the male part comprising a substantially planar body having an outermost body end, a downwardly depending leg disposed at the outermost body end and terminating in an outwardly projecting foot extending substantially parallel to the planar body, the foot having a heel portion oriented away from the outermost body end;

the female part comprising a substantially planar frame having a top, an outermost frame end, an innermost frame end, and defining a cavity for reception and retention of the foot, the cavity being partially roofed in towards the innermost frame end and having a roof and a bottom, thereby defining an open mouth towards the outermost frame end;

the foot, the cavity, and the open mouth being dimensioned so that insertion of the foot into the cavity must be realized by inclining the body of the male part relative to the frame of the female part before bringing the male part and the female part together, retention of the foot in the cavity is realized by pivoting and inserting the male part from an inclined orientation to a co-planar orientation with respect to the female part using the roof of the cavity as a fulcrum, and release of the foot from the cavity is realized by pivoting and moving the male part from the co-planar orientation back to the inclined orientation using the roof of the cavity as the fulcrum before moving the male part and the female part apart;

a fabric strip and an overlay, the overlay having an aperture, the frame of the female part sandwiched between the fabric strip and the overlay such that the aperture corresponds with the open mouth, the fabric strip forms a backing for the frame, and the bottom of the cavity is closed off by the fabric strip; and wherein the frame of the female part has a roof thickness extending from the top of the frame to the roof of the cavity, and an upper surface of the foot is offset rearwardly relative to a rear surface of the body of the male part by a distance of at least the roof thickness.

2. The ultra-slim fastener of claim 1 wherein the cavity has a side wall adjacent the outermost frame end which is inclined towards the outermost frame end from front to rear, and the heel portion of the foot is inclined away from the outermost body end from front to rear.

3. The ultra-slim fastener of claim 2 wherein the heel portion is inclined away from the outermost body end at an angle of between about 6 degrees and about 12 degrees.

4. The ultra-slim fastener of claim 1 wherein the heel portion of the foot is outwardly curved in a lateral direction.

5. The ultra-slim fastener of claim 1 wherein:

the body of the male part includes an upwardly extending male flange adjacent the outermost body end;

the frame of the female part includes an upwardly extending female flange adjacent the open mouth; and the upwardly extending male flange and the upwardly extending female flange are substantially symmetrical in a front view with the male part and the female part fully engaged.

6. The ultra-slim fastener of claim 5 wherein the overlay abuts the upwardly extending female flange.

7. The ultra-slim fastener of claim 5 wherein the frame of the female part is a different color from the overlay.

8. The ultra-slim fastener of claim 1 wherein the female part includes two wings extending laterally from opposing sides of the frame.

9. The ultra-slim fastener of claim 1 wherein only a single female part is sandwiched between the fabric strip and the overlay in a lateral direction.

10. The ultra-slim fastener of claim 1 wherein the body of the male part includes two longitudinal channels positioned on opposing sides of the foot.

11. An ultra-slim fastener for securing a first piece and a second piece of a garment together, the fastener comprising:

a male part configured to be mounted on the first piece and a female part configured to be mounted on the second piece;

the male part comprising a substantially planar body having an outermost body end, a downwardly depending leg disposed at the outermost body end and terminating in an outwardly projecting foot extending substantially parallel to the planar body, the foot having a heel portion oriented away from the outermost body end and a toe portion oriented toward the outermost body end;

the female part comprising a substantially planar frame having a top, an outermost frame end, an innermost frame end, and defining a cavity for reception and retention of the foot, the cavity being partially roofed in towards the innermost frame end and having a roof and a bottom, thereby defining an open mouth towards the outermost frame end;

the foot, the cavity, and the open mouth being dimensioned so that insertion of the foot into the cavity must be realized by inclining the body of the male part relative to the frame of the female part before bringing the male part and the female part together, retention of the foot in the cavity is realized by pivoting and inserting the male part from an inclined orientation to a co-planar orientation with respect to the female part using the roof of the cavity as a fulcrum, and release of the foot from the cavity is realized by pivoting the and moving the male part from the co-planar orientation back to the inclined orientation using the roof of the cavity as the fulcrum before moving the male part and the female part apart;

a fabric strip and an overlay, the overlay having an aperture, the frame of the female part sandwiched between the fabric strip and the overlay such that the aperture corresponds with the open mouth, the fabric strip forms a backing for the frame, and the bottom of the cavity is closed off by the fabric strip; and wherein the heel portion of the foot is curved away from the outermost body end with a radius of curvature oriented from the toe portion to the heel portion.

12. The ultra-slim fastener of claim 11 wherein:

the body of the male part includes an upwardly extending male flange adjacent the outermost body end;

the frame of the female part includes an upwardly extending female flange adjacent the open mouth; and the upwardly extending male flange and the upwardly extending female flange are substantially symmetrical in a front view with the male part and the female part fully engaged.

13. The ultra-slim fastener of claim 11 wherein the cavity has a side wall adjacent the outermost frame end which is inclined towards the outermost frame end from front to rear, and the heel portion of the foot is inclined away from the outermost body end from front to rear.

14. An ultra-slim fastener for securing a first piece and a second piece of a garment together, the fastener comprising:

a male part configured to be mounted on the first piece and a female part configured to be mounted on the second piece;

the male part comprising a substantially planar body having an outermost body end, a downwardly depending leg disposed at the outermost body end and terminating in an outwardly projecting foot extending substantially parallel to the planar body, the foot having a heel portion oriented away from the outermost body end;

the female part comprising a substantially planar frame having a top, an outermost frame end, an innermost frame end, and defining a cavity for reception and retention of the foot, the cavity being partially roofed in towards the innermost frame end and having a roof and a bottom, thereby defining an open mouth towards the outermost frame end;

the foot, the cavity, and the open mouth being dimensioned so that insertion of the foot into the cavity must be realized by inclining the body of the male part relative to the frame of the female part before bringing the male part and the female part together, retention of the foot in the cavity is realized by pivoting and inserting the male part from an inclined orientation to a co-planar orientation with respect to the female part using the roof of the cavity as a fulcrum, and release of the foot from the cavity is realized by pivoting and moving the male part from the co-planar orientation back to the inclined orientation using the roof of the cavity as the fulcrum before moving the male part and the female part apart;

a fabric strip and an overlay, the overlay having an aperture, the frame of the female part sandwiched between the fabric strip and the overlay such that the aperture corresponds with the open mouth, the fabric strip forms a backing for the frame, and the bottom of the cavity is closed off by the fabric strip;

wherein the frame of the female part has a roof thickness extending from the top of the frame to the roof of the cavity, and an upper surface of the foot is offset rearwardly relative to a rear surface of the body of the male part by a distance of at least the roof thickness; and the body of the male part and the frame of the female part each having a weld region including a plurality of protrusions distributed throughout the weld region in a pattern.

15. The ultra-slim fastener of claim 14 wherein each of the plurality of protrusions has a height of between 0.3 mm and 2.0 mm.

16. The ultra-slim fastener of claim 14 wherein each of the plurality of protrusions has one of a conical shape, a cylindrical shape, or a cuboid shape.

17. The ultra-slim fastener of claim 14 wherein the pattern has an interstitial spacing of between 1 mm and 5 mm separating each of the plurality of protrusions.

18. The ultra-slim fastener of claim 14 wherein the plurality of protrusions covers between 40% to 60% of the weld region of each of the male part and the female part.

19. The ultra-slim fastener of claim 14 wherein:

the body of the male part includes an upwardly extending male flange adjacent the outermost body end;

the frame of the female part includes an upwardly extending female flange adjacent the open mouth; and the upwardly extending male flange and the upwardly extending female flange are substantially symmetrical in a front view with the male part and the female part fully engaged.

20. The ultra-slim fastener of claim 14 wherein the heel portion of the foot is outwardly curved in a lateral direction.

21. An ultra-slim fastener for securing a first piece and a second piece of a garment together, the fastener comprising:

a male part configured to be mounted on the first piece and a female part configured to be mounted on the second piece;

the male part comprising a substantially planar body having an outermost body end, a downwardly depending leg disposed at the outermost body end and terminating in an outwardly projecting foot extending substantially parallel to the planar body, the foot having a heel portion oriented away from the outermost body end;

the female part comprising a substantially planar frame having a top, an outermost frame end, an innermost frame end, and defining a cavity for reception and retention of the foot, the cavity being partially roofed in towards the innermost frame end and having a roof and a bottom, thereby defining an open mouth towards the outermost frame end;

the foot, the cavity, and the open mouth being dimensioned so that insertion of the foot into the cavity must be realized by inclining the body of the male part relative to the frame of the female part before bringing the male part and the female part together, retention of the foot in the cavity is realized by pivoting and inserting the male part from an inclined orientation to a co-planar orientation with respect to the female part using the roof of the cavity as a fulcrum, and release of the foot from the cavity is realized by pivoting and moving the male part from the co-planar orientation back to the inclined orientation using the roof of the cavity as the fulcrum before moving the male part and the female part apart;

a fabric strip and an overlay, the overlay having an aperture, the frame of the female part sandwiched between the fabric strip and the overlay such that the aperture corresponds with the open mouth, the fabric strip forms a backing for the frame, and the bottom of the cavity is closed off by the fabric strip;

the body of the male part and the frame of the female part each having a weld region including a plurality of protrusions distributed throughout the weld region in a pattern; and wherein the female part includes two wings extending laterally from opposing sides of the frame.

22. The ultra-slim fastener of claim 21 wherein the body of the male part includes two longitudinal channels positioned on opposing sides of the foot.

* * * * *